US006987458B1

(12) United States Patent
Limmer

(10) Patent No.: US 6,987,458 B1
(45) Date of Patent: Jan. 17, 2006

(54) LEAK STOPPER SYSTEM FOR WATER PLUMBING

(76) Inventor: Garrett L. Limmer, 329 Alum Creek Rd., Smithville, TX (US) 78957

( * ) Notice: Subject to any disclaimer, the term of this patent is extended or adjusted under 35 U.S.C. 154(b) by 6 days.

(21) Appl. No.: 10/679,221

(22) Filed: Oct. 3, 2003

(51) Int. Cl.
*G08B 21/00* (2006.01)

(52) U.S. Cl. ..... 340/605; 340/604

(58) Field of Classification Search ..... 363/20, 363/21.01, 39, 40; 323/222, 290; 340/604, 340/605, 618, 620, 531, 533, 534; 137/487.5, 137/624.11, 624.12; 73/40.5 R
See application file for complete search history.

(56) References Cited

U.S. PATENT DOCUMENTS

| | | | | |
|---|---|---|---|---|
| 4,319,232 A | | 3/1982 | Westphal et al. | 340/604 |
| 5,190,069 A | * | 3/1993 | Richards | 137/312 |
| 5,229,750 A | * | 7/1993 | Welch et al. | 340/605 |
| 5,503,175 A | | 4/1996 | Ravilious et al. | 137/1 |
| 5,568,825 A | * | 10/1996 | Faulk | 137/624.11 |
| 6,025,788 A | * | 2/2000 | Diduck | 340/870.16 |
| 6,105,607 A | * | 8/2000 | Caise et al. | 137/487.5 |
| 6,147,613 A | * | 11/2000 | Doumit | 340/605 |
| 6,310,555 B1 | | 10/2001 | Stern | 340/605 |
| 6,339,951 B1 | | 1/2002 | Kashmiri et al. | 73/40 |
| 6,526,807 B1 | * | 3/2003 | Doumit et al. | 73/40.5 R |

* cited by examiner

*Primary Examiner*—Van T. Trieu
(74) *Attorney, Agent, or Firm*—Derek R. Van Gilder

(57) ABSTRACT

A leak-stopper system for water plumbing (2) has a leak-probe circuit (1) positioned in water-detection proximity to water plumbing for a building. Leak sensors (3) which include three-probe sensors (14) are spaced apart on the leak-probe circuit for conveying existence of leakage water (7) electrically to a control board (4) with electrical communication to visual signalers (5) and to a plumbing valve (6) for shutting off water to the water plumbing automatically before leakage in the water plumbing can be fixed and to indicate where one or more leaks are for being fixed to prevent water damage to a building or its contents. Preferably, electrical current to the leak-probe circuit and to the plumbing valve is from a power source that includes an isolated power source which can be a chargeable battery (9) or other DC power supplier (12) for supplying a safe level of current for a predetermined period of leak-detection time in case of power outage to the building.

20 Claims, 3 Drawing Sheets

LEAK STOPPER SYSTEM FOR WATER PLUMBING

BACKGROUND OF THE INVENTION

1. Field of the Invention

This invention relates to detecting water leaks in water plumbing of commercial and residential buildings for shutting water off automatically to prevent water-leak damage before the leaks can be repaired.

2. Relation to Prior Art

There are numerous detectors of liquid leaks in numerous liquid containment systems, but none known to detect leaks with—an—a three-probe electric detector wired to an electric shutoff valve for shutting off water in water plumbing of commercial and residential buildings in order to prevent water-leak damage to building structure and building contents before the leaks can be repaired as taught by this invention.

Prior art that is known and related but different includes the following:

| U.S. Pat. No. | Inventor | Disclosure Date |
|---|---|---|
| U.S. Pat. No. 6,526,807 | Doumit et al | 03-2003 |
| U.S. Pat. No. 6,339,951 B1 | Kashmiri et al | 01-2002 |
| U.S. Pat. No. 6,310,555 B1 | Stern | 10-2001 |
| U.S. Pat. No. 6,147,613 | Doumit | 11-2000 |
| U.S. Pat. No. 6,105,607 | Caise et al | 08-2000 |
| U.S. Pat. No. 6,025,788 | Diduck | 02-2000 |
| U.S. Pat. No. 5,568,825 | Faulk | 10-1996 |
| U.S. Pat. No. 5,503,175 | Ravillous et al | 04-1996 |
| U.S. Pat. No. 5,229,750 | Welch et al | 07-1993 |
| U.S. Pat. No. 5,190,069 | Richards | 03-1993 |
| U.S. Pat. No. 4,319,232 | Westphal et al | 03-1982 |

SUMMARY OF THE INVENTION

Objects of patentable novelty and utility taught by this invention are to:

- provide immediate and reliable detection of any water leakage, no matter how tiny, in a plumbing system of a commercial or residential building;
- detect and show on a plumbing-system diagram at a desired control position the exact location of any and all the water leakage;
- automatically shut off water to the water leakage immediately before it can cause damage and can be fixed;
- have a shutoff valve that is suitable for potable-water use;
- utilize an electrical circuit for detecting the leakage and shutting off the water;
- employ an isolated power system that can include battery power for current-level safety and for safe-time independence from outside sources of electricity; and
- provide a computerized analysis and recording of all pertinent leakage factors.

This invention accomplishes these and other objectives with a leak-stopper system for water plumbing with a leak-probe circuit positioned in water-detection proximity to water plumbing for a building and having electrical communication from a predetermined plurality of predeterminedly spaced-apart leak sensors on the leak-probe circuit to a control board. Leak signalers on the control board are in electrical communication with the leak sensors for electrically detecting and signaling location of any water leakage of the water plumbing proximate one or more of the leak sensors to the control board. The water plumbing includes a plumbing valve with predetermined features for shutting off water to the water plumbing predeterminedly in response to detection of leakage of the water plumbing in order to allow the leakage to be fixed before water damage occurs to the building or to contents of the building.

Preferably, electrical current to the leak-probe circuit and to the plumbing valve is from a power source that includes an isolated power source which can be a chargeable battery for supplying a safe level of current for a predetermined period of leak-detection time in case of power outage to the building.

The leak sensors can include three-probe sensors having an input probe intermediate a first output probe and a second output probe. The probe circuit conveys current to the first output probe and to the second output probe. Electrical circuit between at least the first output probe or the second output probe and the input probe is closable with leakage water for conveying current from the input probe to a predetermined signaler of leakage on the control board.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
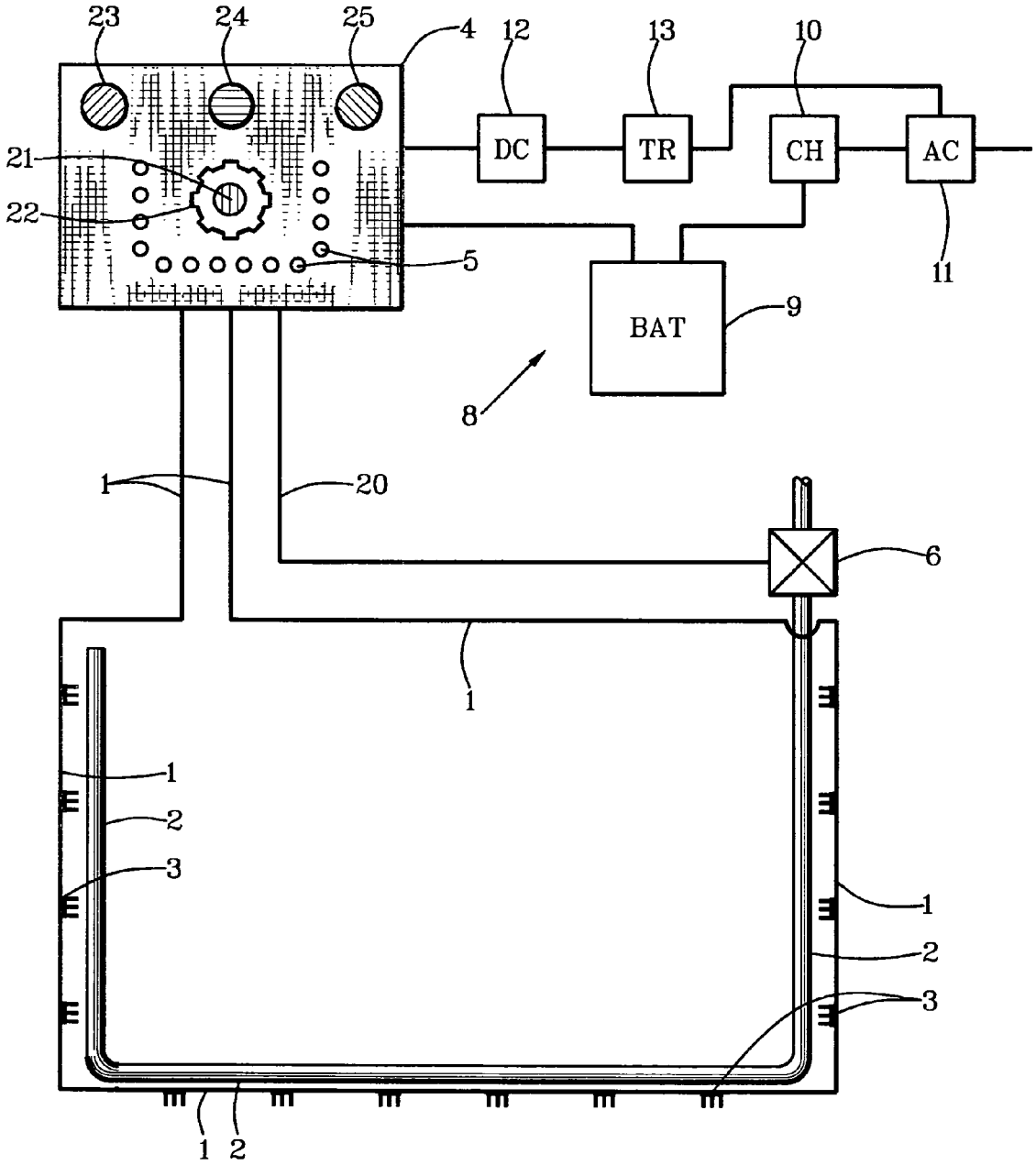
FIG. 1 is a schematic plan drawing of the leak-stopper system.

Listed numerically below with reference to the drawings are terms used to describe features of this invention. These terms and numbers assigned to them designate the same features throughout this description.

1. Leak-probe circuit
2. Water plumbing
3. Leak sensors
4. Control board
5. Visual leak signalers
6. Plumbing valve
7. Leakage water
8. Electrical source
9. Chargeable battery
10. Charger
11. AC power source
12. DC power supplier

Figure 2:
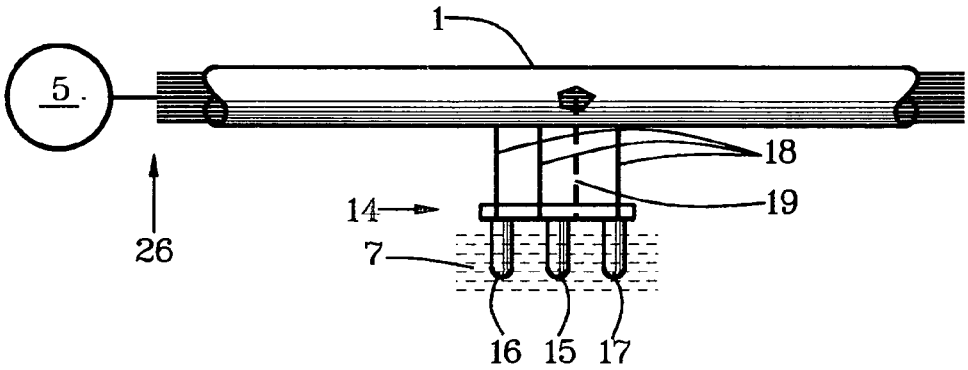
FIG. 2 is a partially cutaway fragmentary drawing of a leak sensor in electrical communication with a visual signaler through a signal line in a leak-probe circuit.
Figure 3:
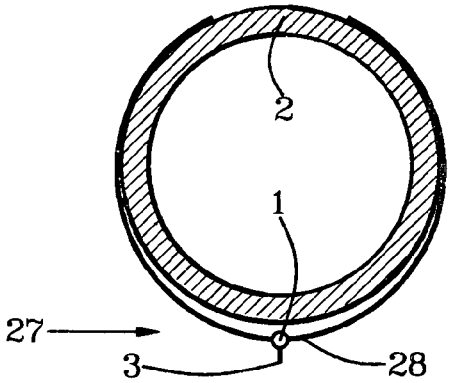
FIG. 3 is an end view of a water pipe in water plumbing having a leak-probe circuit attached to the water pipe with a pipe clasp.
Figure 4:
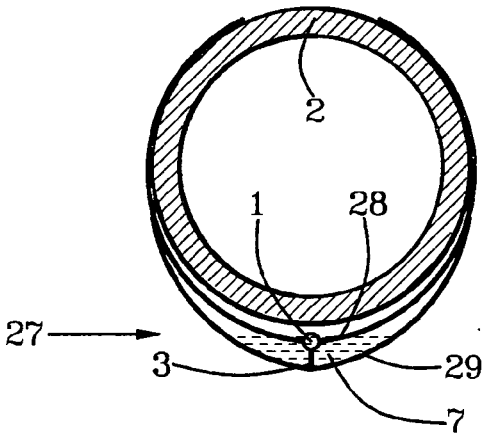
FIG. 4 is an end view of the water pipe in the water plumbing having the leak-probe circuit attached to the water pipe with the pipe clasp and further having a clasp tray below the pipe clasp and the leak-probe circuit for collecting leakage water for its conveyance to leak probes.
Figure 5:
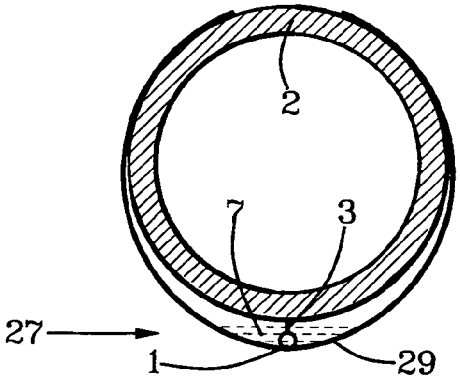
FIG. 5 is an end view of the water pipe in the water plumbing having the leak-probe circuit attached to the clasp tray for collecting leakage for its conveyance to leak probes.
Figure 6:
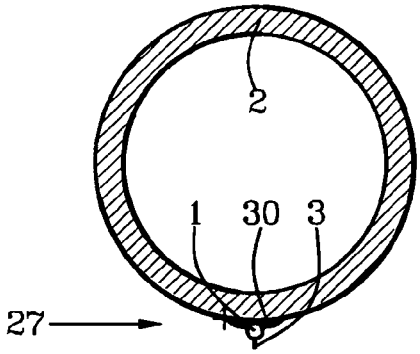
FIG. 6 is an end view of the water pipe in the water plumbing having the leak-probe circuit attached directly to the water plumbing with adhesive.
Figure 7:
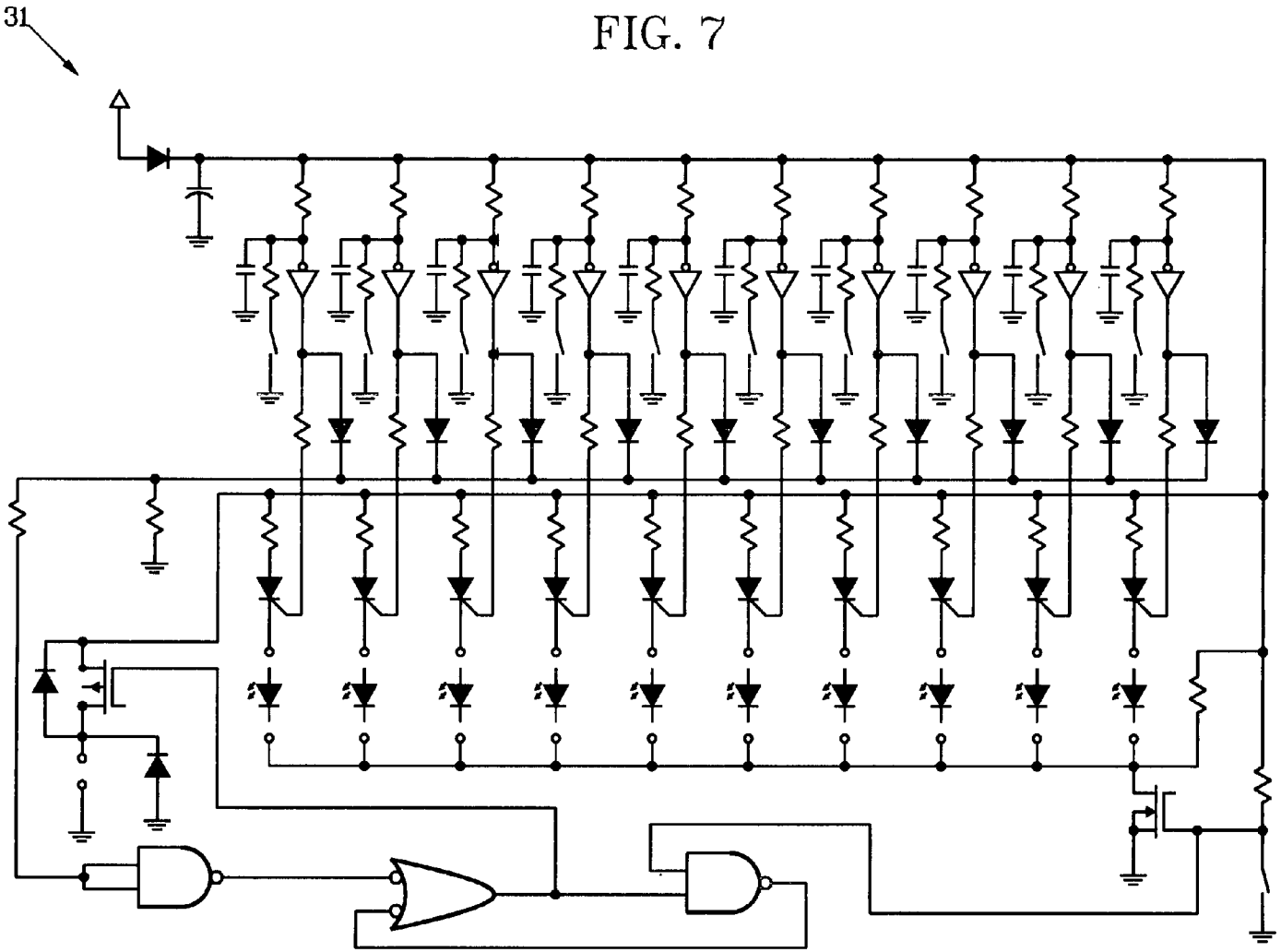
FIG. 7 is a diagram of an electronic circuit for the leak-stopper system.

13. Transformer
14. Three-probe sensor
15. Output probe
16. First input probe
17. Second input probe
18. Input connectors
19. Output connector
20. Valve-control line
21. Pushbutton toggle switch
22. Rotational knob
23. Audio signaler
24. Remote-control connection
25. Network connection
26. Signal line
27. Circuit attachment
28. Pipe clasp
29. Clasp tray
30. Adhesive
31. Electronic circuit Referring to FIGS. 1–2, the leak-stopper system for water plumbing includes a leak-probe circuit 1 positioned in water-detection proximity to water plumbing 2 for a building. The electrical-probe circuit 1 has electrical communication from a predetermined plurality of predeterminedly spaced-apart leak sensors 3 on the leak-probe circuit 1 to a control board 4.

Visual leak signalers 5 on the control board 4 are in electrical communication with the leak sensors 3 for electrically detecting and signaling location of any water leakage 7 of the water plumbing 2 proximate one or more of the leak sensors 3 to at least one of the visual leak signalers 5 on the control board 4.

The water plumbing 2 has a plumbing valve 6 for shutting off water to the water plumbing 2 predeterminedly in response to detection of leakage of the water plumbing 2 in order to allow the leakage to be fixed before water damage occurs to the building or to contents of the building.

The plumbing valve can include a potable water valve.

The leak sensors 3 are articulated for detecting water leakage by closing of circuitry of the leak sensors 3 with leakage water 7 for communicating position of the leakage water 7 by communicating position of the at least one leak sensors 3 with circuitry closed by the leakage water 7 to predetermined visual leak signalers 5 on the control board 4.

The control board 4 is articulated in coordination with the water plumbing 2 and the electrical-probe circuit 1 for indicating location of the water leakage 7 by indicating location of at least one of the leak sensors 3 with circuitry closed by the leakage water 7.

An electrical source 8 supplies user-safe electrical current to components of the leak-stopper system for detecting leaks, for communicating their location, for operating the plumbing valve and for any other related functions.

The power source 8 includes an isolated power source for supplying a user-safe level of current for a predetermined period of leak-detection time in case of power outage to the building. The isolated power source can include a chargeable battery 9 that is chargeable by a charger 10 in communication with an AC power source 11 to the building. The isolated power source can include a predetermined DC power supplier 12 with DC current from a transformer 13 in communication with the AC power source 11 to the building.

The leak sensors 3 can include three-probe sensors 14 having an output probe 15 intermediate a first input probe 16 and a second input probe 17. The probe circuit 1 is in electrical communication with the first input probe 16, the second input probe 17 and the output probe 15 through input connectors 18. The probe circuit 1 is in return electrical communication with the input probe 15 through an output connector 19. The first input probe 16 and a second input probe 17 are articulated to convey current through leakage water 7 to the output probe 15 and the output probe 15 is articulated to receive the current through the leakage water 7 for conveying the current from the leakage water 7 through the output connector 19 and into the probe circuit 1 for communication to a designated visual leak signaler 5 on the control board 4.

Different from conventional water sensors the first input probe 16 and the second input probe 17 can be structured and spaced apart predeterminedly for effectiveness of communication of current through predeterminedly aqueous liquid to the output probe 15 of the three-probe sensors 14 positioned proximate predetermined water plumbing 2 in accordance with knowledge of those skilled in the art.

The leak-probe circuit 1 can include a valve-control line 20 in communication with the plumbing valve 6 from the control board 4 for closing the plumbing valve 6 automatically in response to communication of detection of a leak in the water plumbing 2 by at least one of the leak sensors 3. The plumbing valve 6 is articulated to be closed for preventing water from entering the water plumbing 2 by the communication from the control board 4.

An override switch can be included on the control board 4 for manually overriding automatic closing of the plumbing valve 6. The override switch can include a pushbutton toggle switch 21.

An override-time regulator can be included on the control board 4 for regulating time of override of automatic closing of the plumbing valve 6. The override-time regulator can include a rotational knob 22 for being rotated in a rotational direction predeterminedly for increase of time of override of the automatic closing of the plumbing valve 6.

The visual leak signalers 5 can include LED's.

Included optionally on the control board 4 can be an audio signaler 23 of leakage, a remote-control connection 24 for optionally hard-wire or wireless remote control of the control board 4, the plumbing valve 6 and any other features of the leak-stopper system, and a network connection 25 for remote control of the leak-stopper systems that includes a plurality thereof.

The plumbing valve 6 preferably includes a potable-water valve.

The leak-probe circuit 1 can include a plurality of signal lines 26 with each of the signal lines 26 having electrical communication from a predetermined leak sensor 3 to a predetermined signaler 5.

Referring to FIGS. 3–6, the leak-stopper system for water plumbing can further comprise a circuit attachment 27 for attaching the leak-probe circuit 1 to the water plumbing 2.

The circuit attachment 27 can include a pipe clasp 28.

The circuit attachment 27 can include a clasp tray 29 for clasping onto the water plumbing 2 for collecting the leakage water 7 and for conveying the leakage water 7 to the leak sensors 3. In addition to the clasp tray 29, the circuit attachment 27 can include the pipe clasp 28.

The circuit attachment 27 can include an adhesive 30 for adhering the leak probe 1 to the water plumbing 2.

The leak-stopper system for water plumbing can include an electronic circuit 31 for communicating leak detection by the leak sensors 3 to the visual leak signalers 5 and for conveying shutoff communication to the plumbing valve 6.

A new and useful leak-stopper system for water plumbing having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A leak-stopper system for water plumbing comprising:

a leak-probe circuit (1) positioned in water-detection proximity to water plumbing (2) for a building;

an electrical circuit having electrical communication from a predetermined plurality of predeterminedly spaced-apart leak sensors (3) on the leak-probe circuit (1) to a control board (4);

the leak sensors (3) include three-probe sensors (14) having an output probe (15) intermediate a first input probe (16) and a second input probe (17);

the leak-probe circuit (1) is in electrical communication with the first input probe (16) and the second input probe (17) through input connectors (18);

the leak-probe circuit (1) is in return electrical communication with the output probe (15) through an output connector (19);

the first input probe (16) and a second input probe (17) are articulated to convey current through leakage water (7) to the output probe (15) and the output probe (15) is articulated to receive the current through the leakage water (7) for conveying the current from the leakage water (7) through the output connector (19) and into the leak-probe circuit (1) for communication to designated visual leak signalers (5) on the control board (4);

visual leak signalers (5) on the control board (4) being in electrical communication with the leak sensors (3) for electrically detecting and signaling location of any water leakage of the water plumbing (2) proximate one or more of the leak sensors (3) to at least one of the visual leak signalers (5) on the control board (4);

the water plumbing (2) including a plumbing valve (6) with predetermined features for shutting off water to the water plumbing predeterminedly in response to detection of leakage of the water plumbing (2) in order to allow the water leakage to be fixed before water damage occurs to the building or to contents of the building;

the leak sensors (3) being articulated for detecting water leakage (7) by closing of circuitry of the leak sensors (3) predeterminedly with leakage water (7) for communicating position of the leakage water (7) by communicating position of at least one of the leak sensors (3) with circuitry closed by the leakage water (7) to at least one of predetermined visual leak signalers (5) on the control board (4);

the control board (4) being articulated in coordination with the water plumbing (2) and the leak-probe circuit (1) for indicating location of the leakage water (7) by indicating location of at least one of the leak sensors (3) with circuitry closed by the leakage water (7); and an electrical source (8) for supplying user-safe electrical current to components of the leak-stopper system for detecting leaks, for communicating their location, for operating the plumbing valve (6) and for other related functions.

2. The leak-stopper system for water plumbing of claim 1, wherein:

the electrical source (8) includes an isolated power source for supplying a user-safe level of current for a predetermined period of leak-detection time in case of power outage to the building.

3. The leak-stopper system for water plumbing of claim 2 wherein:

the isolated power source includes a chargeable battery (9) that is chargeable by a charger (10) in communication with an AC power source (11) to the building.

4. The leak-stopper system for water plumbing of claim 2 wherein:

the isolated power source includes a predetermined DC power supplier (12) with DC current from a transformer (13) in communication with the AC power source (11) to the building.

5. The leak-stopper system for water plumbing of claim 1 wherein:

the leak-probe circuit (1) includes a valve-control line (20) in communication with the plumbing valve (6) from the control board (4) for closing the plumbing valve (6) automatically in response to communication of detection of a leak in the water plumbing (2) by at least one of the leak sensors (3); and the plumbing valve (6) is articulated to be closed for preventing water from entering the water plumbing (2) by the communication from the control board (4).

6. The leak-stopper system for water plumbing of claim 5 and further comprising:

an override switch for manually overriding automatic closing of the plumbing valve (6).

7. The leak-stopper system for water plumbing of claim 6, wherein:

the override switch includes a pushbutton toggle switch (21).

8. The leak-stopper system for water plumbing of claim 6 and further comprising:

an override-time regulator for regulating time of override of automatic closing of the plumbing valve (6).

9. The leak-stopper system for water plumbing of claim 8, wherein:

the override-time regulator includes a rotational knob (22) for being rotated in a rotational direction predeterminedly for increase of time of override of the automatic closing of the plumbing valve (6).

10. The leak-stopper system for water plumbing of claim 1, wherein:

the visual leak signalers (5) include LED's.

11. The leak-stopper system for water plumbing of claim 1 and further comprising:

an audio signaler (23) on the control board (4) for signaling leakage.

12. The leak-stopper system for water plumbing of claim 1 and further comprising:

a remote-control connection (24) for optionally hard-wire or wireless remote control of the control board (4), the plumbing valve (6) and other features of the leak-stopper system.

13. The leak-stopper system for water plumbing of claim 1 and further comprising:

a network connection (25) for remote control of the leak-stopper system that includes a plurality thereof.

14. The leak-stopper system for water plumbing of claim 1, wherein:

the leak-probe circuit (1) includes a plurality of signal lines (23) with each of the signal lines (23) having electrical communication from a predetermined leak sensor (3) to a predetermined visual leak signaler (5).

15. The leak-stopper system for water plumbing of claim 1 and further comprising:

a circuit attachment (27) for attaching the leak-probe circuit (3) to the water plumbing (2).

16. The leak-stopper system for water plumbing of claim 15, wherein:

the circuit attachment (27) includes a pipe clasp (28).

17. The leak-stopper system for water plumbing of claim 15, wherein:

the circuit attachment (27) includes a clasp tray (29) for clasping onto the water plumbing (2) for collecting the leakage water (7) and for conveying the leakage water (7) to the leak sensors (3).

18. The leak-stopper system for water plumbing of claim 17, wherein:

the circuit attachment (27) includes the pipe clasp (28).

19. The leak-stopper system for water plumbing of claim 15, wherein:

the circuit attachment (27) includes an adhesive (30) for adhering the leak-probe circuit (1) to the water plumbing (2).

20. The leak-stopper system for water plumbing of claim 1 and further comprising:

an electronic circuit (31) for communicating leak detection by the leak sensors (3) to the visual leak signalers (5) and for conveying shutoff communication to the plumbing valve (6).

* * * * *